US006029951A

United States Patent [19]

Guggari

[11] Patent Number: 6,029,951

[45] Date of Patent: Feb. 29, 2000

[54] CONTROL SYSTEM FOR DRAWWORKS OPERATIONS

[75] Inventor: Mallappa I. Guggari, Cedar Park, Tex.

[73] Assignee: Varco International, Inc., Orange, Calif.

[21] Appl. No.: 09/121,989

[22] Filed: Jul. 24, 1998

[51] Int. Cl.[7] ..... B66D 1/48

[52] U.S. Cl. ..... 254/269; 254/275; 254/362; 254/375; 187/250; 173/11; 175/27

[58] Field of Search ..... 254/273, 274, 254/275, 276, 269, 240, 362, 375; 187/250, 276, 277, 306, 307; 173/11; 75/27; 340/665, 666

[56] References Cited

U.S. PATENT DOCUMENTS

| | | | |
|---|---|---|---|
| 3,759,489 | 9/1973 | Jones | 254/273 |
| 3,918,552 | 11/1975 | Kameyama et al. . | |
| 4,046,355 | 9/1977 | Martin | 254/273 |
| 4,128,888 | 12/1978 | Sheldon et al. | 364/565 |
| 4,139,891 | 2/1979 | Sheldon et al. | 340/666 |
| 4,319,665 | 3/1982 | Komuro et al. . | |
| 4,434,971 | 3/1984 | Cordrey | 254/375 X |
| 4,519,585 | 5/1985 | Furrow | 254/273 |
| 4,545,017 | 10/1985 | Richardson | 254/276 X |
| 4,875,530 | 10/1989 | Frink et al. | 254/269 X |
| 4,928,021 | 5/1990 | Yonemoto . | |
| 4,975,627 | 12/1990 | Reddy . | |
| 5,342,020 | 8/1994 | Stone . | |

FOREIGN PATENT DOCUMENTS

| | | | |
|---|---|---|---|
| 1379318 | 1/1975 | United Kingdom | 254/273 |

*Primary Examiner*—Donald P. Walsh
*Assistant Examiner*—Emmanuel M. Marcelo
*Attorney, Agent, or Firm*—Madan, Mossman & Sriram P.C.

[57] ABSTRACT

The system and method for use with a drawworks having a rotatable drum on which a line is wound, wherein the drawworks and the line are used for facilitating movement of a load suspended on the line, includes a drawworks control system for monitoring and controlling the drawworks. A brake arrangement is connected to the rotatable drum for limiting the rotation of the rotatable drum and at least one electrical motor is connected to the rotatable drum for driving the rotatable drum. A load signal representative of the load on the line is produced and a calculated torque value based on the load signal and electrical motor capacity is provided. The drawworks control system provides a signal representative of the calculated torque value to the electrical motor wherein pre-torquing is generated in the electrical motor in response to the signal. Control of the rotation of the rotatable drum is transferred from the brake arrangement to the electrical motor when the electrical motor pre-torquing level is substantially equal to the calculated torque value.

25 Claims, 4 Drawing Sheets

CONTROL SYSTEM FOR DRAWWORKS OPERATIONS

BACKGROUND OF THE INVENTION

1. Field of the Invention

This invention relates to a drawworks control system for monitoring and controlling a drawworks including a rotatable drum and bearing a load, particularly to drawworks used for oil well drilling rigs in the performance of various operations on the oil well drilling rig.

2. Description of the Related Art

In the oil and gas drilling arts, it is well known to use a drawworks in connection with the rig or derrick to hold and to raise and lower a drill string and associated equipment into and out of the wellbore. Typically, a traveling block having an appropriate hook or other similar assembly is used for the raising and lowering operations. The traveling block is secured in block and tackle fashion to a secured crown block or other limit fixture located at the top of the rig or derrick. The raising and lowering operation of the traveling block is performed by means of a hoist cable or line, one end of which is secured to the rig floor or ground forming a "dead line', with the other end being secured to the drawworks proper and forming the "fast line". Although the load bearing assembly could take another form in a particular drilling rig embodiment, for purposes herein all such load bearing assemblies regardless of appearance are, for convenience, referred to as the "traveling block", which term also includes the hook or other attachment means, the associated equipment or other load associated therewith as it moves upwardly and downwardly.

The drawworks includes a rotatable cylindrical drum upon which the cable or fast line is wound by means of a suitable prime mover and power assembly. Typically, the drawworks and traveling block assembly is generally controlled and operated by an operator sometimes referred to as the driller. Thus, in association with the raising of the traveling block, the prime mover is controlled by the operator typically by way of a foot or hand throttle. Similarly, in connection with the lowering operation, the drawworks is supplied with one or more suitable brakes, also controlled by the operator, usually with hand controls. Generally, the primary brake, which typically is a friction brake of either a band or disk type, is supplemented with an auxiliary brake, such as an eddy current type brake or a magnetic brake. The drawworks may also be provided with an emergency brake which can be activated in the event of a power failure to the eddy current brake or when the traveling block exceeds a maximum safe falling speed.

The line or wireline is usually a wire rope or steel cable, although other materials have also been used. The well drill string and associated equipment, even in a moderately deep well is highly flexibly and relatively easy to damage. Controlling the drill string and drill string weight applied to the drill bit (the weight-on-bit or WOB) is very important in drilling efficiency. Also, inasmuch as a typical load borne by the traveling block and assembly can exceed four hundred tons or more, an operational error by the operator or driller or a failure in any of the systems controlling the speed or rate of upward or downward movement of the traveling block could be hazardous and even catastrophic, resulting in damage to equipment, personal injury, and even loss of human life. Damage to equipment also occurs when control of the movement of the traveling block is transferred between the prime mover and the brakes or vice-versa. Typically this transfer causes jerking of the equipment which can damage the traveling block and equipment assembly causing unsafe conditions on the drilling rig.

The method and apparatus of the present invention provides a system for monitoring and controlling a drawworks system for facilitating movement of a load suspended from the drawworks system and providing an improved method of transferring control between the brake arrangement and the prime mover associated with the drawworks system.

SUMMARY OF THE INVENTION

The system and method of the present invention for use with a drawworks having a rotatable drum on which a line is wound, wherein the drawworks and the line are used for facilitating movement of a load suspended on the line, includes a drawworks control system for monitoring and controlling the drawworks. A brake arrangement is connected to the rotatable drum for limiting the rotation of the rotatable drum and at least one electrical motor is connected to the rotatable drum for driving the rotatable drum. A load signal representative of the load on the line is produced and a calculated torque value based on the load signal and electrical motor capacity is provided. The drawworks control system provides a signal representative of the calculated torque value to the electrical motor wherein pre-torquing is generated in the electrical motor in response to the signal. Control of the rotation of the rotatable drum is transferred from the brake arrangement to the electrical motor.

When the rotation of the rotatable drum is in a hoisting direction or is stationary, the drawworks control system provides a disabling signal for commencing a gradual release of the brake arrangement from the rotatable drum. When the electrical motor pre-torquing level is substantially equal to the calculated torque value, the drawworks control system transfers control of the rotation of the rotatable drum to the electrical motor while fully releasing the brake arrangement from the rotatable drum.

When the rotation of the rotatable drum is in a lowering direction, the drawworks control system provides an enabling signal for engaging the brake arrangement to limit rotation of the rotatable drum and increases the calculated torque value. When the rotation of the rotatable drum is no longer in a lowering direction and, when the electrical motor pre-torquing level is substantially equal to the increased calculated torque value, the drawworks control system transfers control of the rotation of the rotatable drum to the electrical motor while fully releasing the brake arrangement from the rotatable drum.

The system of the present invention further includes a linear electrical output signal representing a selected velocity and direction of movement of the load to the drawworks control system, wherein the drawworks control system provides control signals to the electrical motor to control the movement of the load according to the selected velocity and direction. For example, the linear electrical output signal is provided by a movement control device, such as throttle joystick.

When the electrical motor is a direct current motor the system of the present invention further includes connecting a silicon controlled rectifier circuit to the electrical motor. The drawworks control system provides a signal representing the calculated torque value in the form of an armature current limit to the silicon controlled rectifier circuit for generating pre-torquing of the electrical motor. When the electrical motor is an alternating current motor the system of the present invention further includes connecting an alternating current drive to the electrical motor. The drawworks control system provides a torque command signal representing the calculated torque value signal to the alternating current drive for generating pre-torquing of the electrical motor.

The method and system of the present invention including the generation of pre-torquing in the motors, provides an improved system of transferring control between the brake arrangement and the motors associated with the drawworks system.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION OF THE PREFERRED EMBODIMENTS

Figure 1:
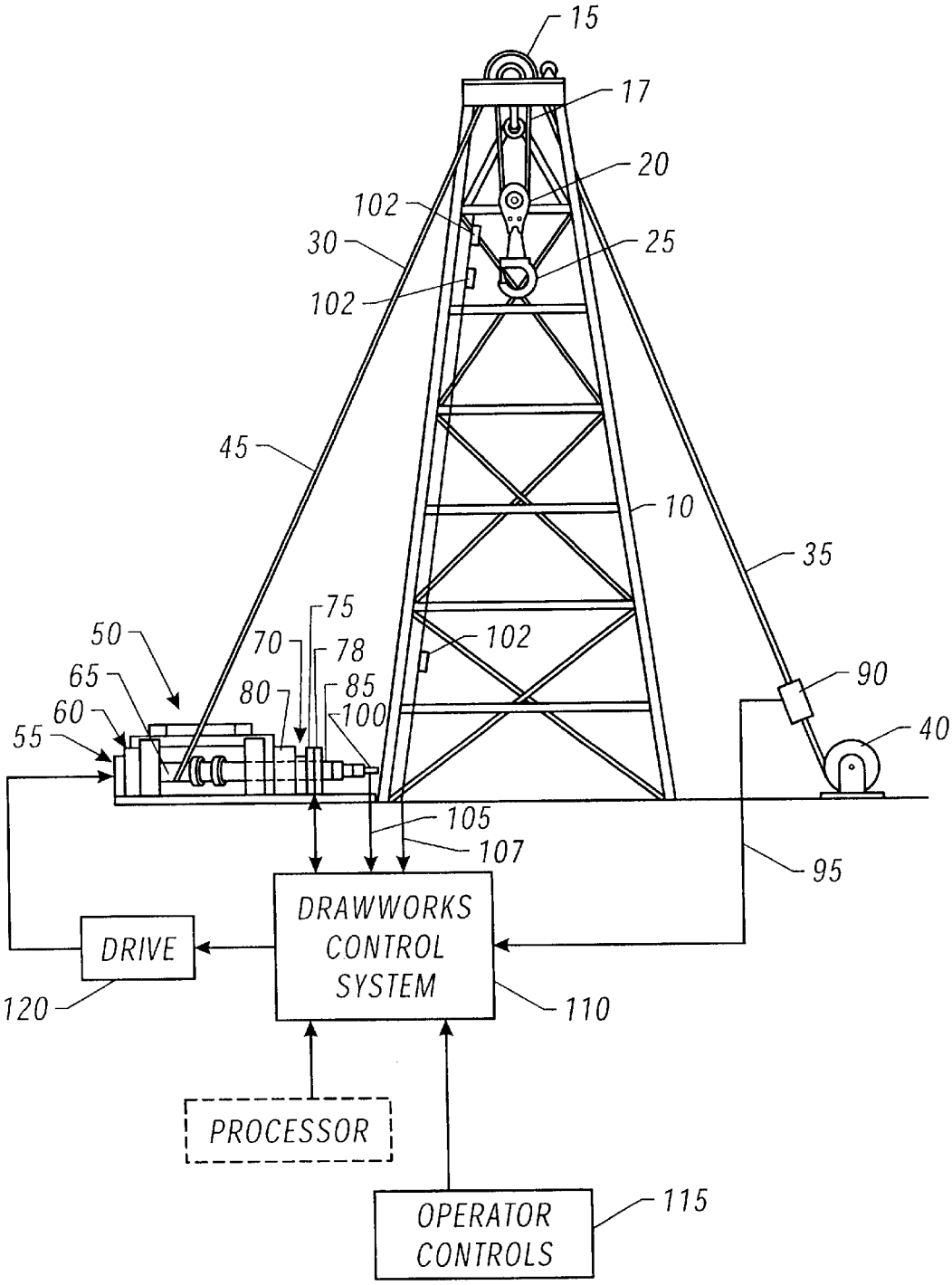
FIG. 1 is a schematic diagram of a drilling rig and traveling block assembly including a drawworks control system according to the present invention.
Figure 2:
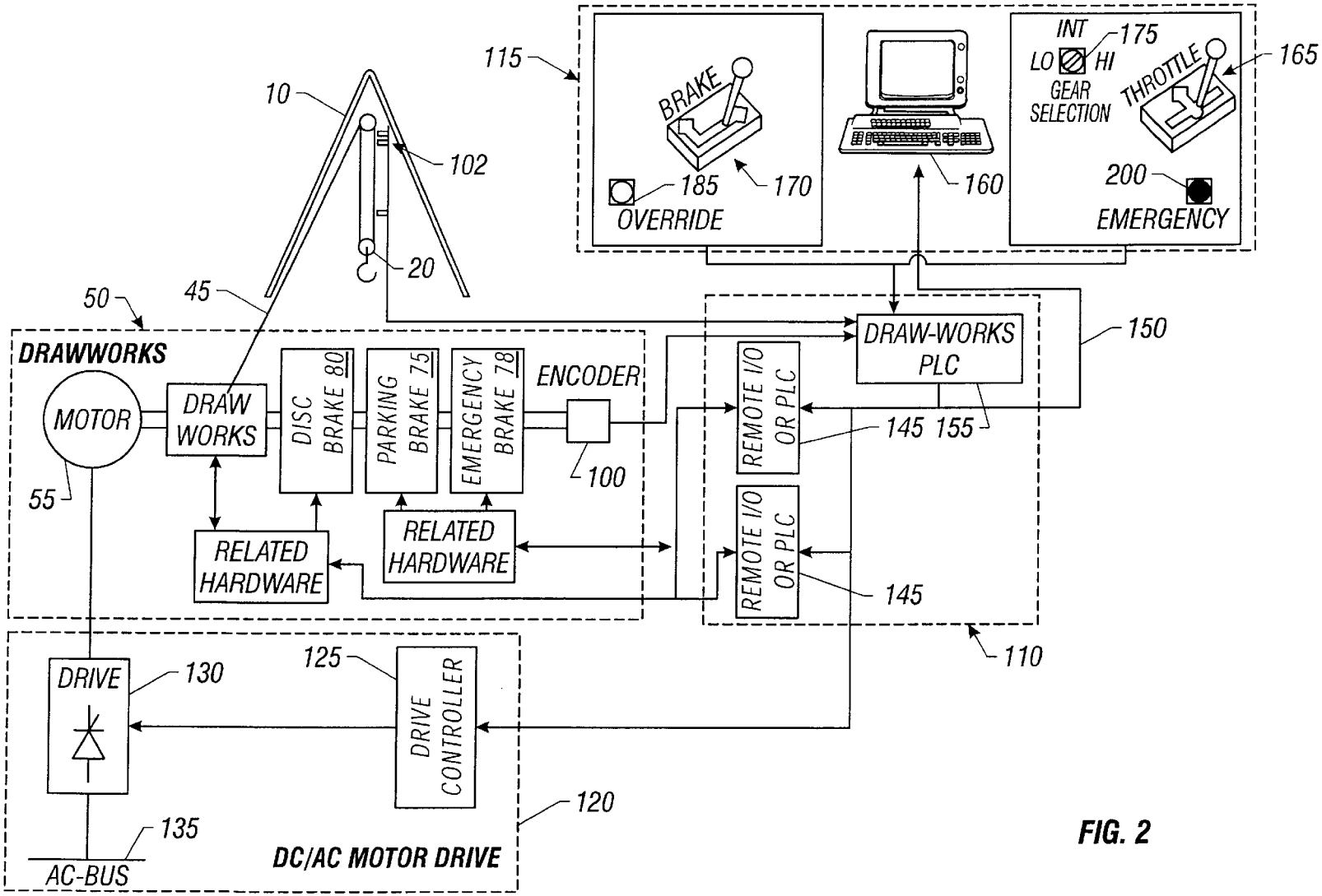
FIG. 2 is a block diagram of the drawworks and drawworks control system of FIG. 1 including a signal flow diagram.

Referring to FIGS. 1 and 2, diagrams of a drawworks control system according to the present invention connected to a drilling rig and including a traveling block is illustrated. A derrick 10 supports, at the upper end of the derrick 10, a crown block 15. Suspended by a rope arrangement 17 from the crown block 15 is a traveling block 20, or load bearing part, for supporting a hook structure 25. Alternatively, the traveling block 20 can be formed as a hook block or other conventional related load bearing parts of a hoist assembly attached to the rope arrangement 17. As used herein, the term "hook block" refers to the load bearing part 20 of the hoist assembly.

A hoisting line 30 is securely fixed at one end to ground by means of a dead line 35 and a dead line anchor 40. The other end of the hoisting line 30 forms a fast line 45 attached to drawworks 50. The drawworks 50 includes one or more electrical motors 55 and a transmission 60 connected to a cylindrical rotatable drum 65 for wrapping and unwrapping the fast line 45 as required for operation of the associated crown block 15 and traveling block 20. The rotatable drum 65 is also referred to as a winding drum or a hoisting drum. The brake arrangement 70 preferably includes a primary friction brake 80, typically a band type brake or disk brake, an auxiliary brake 75, such as an eddy current type brake or a magnetic brake, and an emergency brake 78. The brake arrangement 70 is connected to the drawworks 50 by driveshaft 85 of the drawworks 50. The brake arrangement 70 is typically actuated either hydraulically or pneumatically, using, for example, a pneumatic cylinder that is engaged by rig air pressure by way of an electronically actuated air valve.

In the preferred embodiment illustrated in FIG. 1, a load sensing device, such as a strain gage 90 is affixed to the dead line 35, and produces an electrical signal on output line 95 representative of the tension in dead line 35 and consequently, the load carried by traveling block 20. Various tension measuring devices may be employed to indicate the tension conditions on the line 30. The actual hook load is calculated using the strain gage 90 input in conjunction with the number of lines strung and a calibration factor. Alternatively, a conventional load cell, hydraulic tension transducers or other load measuring device may be associated with derrick 10 to provide an electrical output load signal representative of the load carried by traveling block 20.

A measuring device, such as an encoder 100, for example, is affixed to the driveshaft 85. An electrical output signal representative of the rotation of the rotatable drum 65 is produced on line 105 from encoder 100 as drum 65 rotates to pay out or wind up fast line 45 as the traveling block 20 descends or rises. The frequency of the encoder is used to measure the velocity of the traveling block 20 movement, typically, by calculating the actual drum 65 speed and ultimately the traveling block 20 speed based on lines strung, the diameter of the drum 65, the number of line wraps and the line size. Alternatively, the velocity of the traveling block 20 movement is calculated from the change in the vertical position of the traveling block 20.

A plurality of positioning sensors, such as proximity switches 102, are used to determine the position of the traveling block 20. An electrical output signal from the proximity switches 102 representative of the position of the traveling block 20 will be produced on line 107 and the actual position of the traveling block 20 is calculated based on the drum 65 diameter, the line 30 size and number of lines, the line stretch, and the weight-on-bit (WOB) which effects line stretch.

A problem encountered in typically operated drawworks systems is the uneven transfer of the drawworks control from the mechanical brake arrangement to the electrical motors causing a jerking of the traveling block and associated equipment. The drawworks control system of the present invention is used to monitor and control the drawworks and hence the velocity and position of the traveling block 20 during various operations associated with oil well drilling and provides for a smooth, non-jerking transfer of the torque load between the mechanical brake arrangement and the electrical motors providing an improved method of transferring control.

Referring again to FIGS. 1 and 2, the drawworks control system 110 receives electrical output signals from the proximity switches 102, the encoder 100 and the stain gage 90, and is connected to the brake arrangement 70. The drawworks control system 110 is connected to a driller or operator control center 115 located on or near the derrick 10. The drawworks control system 110 is also connected to the electrical motor 55 through a drive 120. The electrical motor 55 is an alternating current (ac) motor or a direct current (dc) motor and the drive 120 is an ac or a dc drive respectively. The drive 120, for example, includes a controller 125, such as a programmable logic controller (PLC) and one or more power electronic switches 130 connected to an ac bus 135. For example, the drive for a dc motor includes an electronic switch 130 such as a silicon controlled rectifier for ac/dc conversion.

Critical control signals are hardwired to the drawworks control system 110 from the operator control center 115. Alternatively, a separate workstation (not shown), located, for example, in an equipment room on or near the derrick 10, can be connected to the drawworks control system 110 to provide an additional user interface and configuration signals. The drawworks control system 110 includes a programmable logic controller (the drawworks PLC 155) and is interfaced with the drive 120 using, for example, a serial communication connection 150 such as, for example, an optical linkage and/or hard-wired linkage. Two or more remote programmable logic controller (PLC) input/output (I/O) units 145 are used to control the transmission 60 and brake arrangement 70 of the drawworks 50. Alternatively, a processor 140 is also connected to the drawworks control system 110 for providing operating parameters and calculated values during the performance of various drilling rig operations. The processor 140 is a conventional signal processor, such as a general-purpose digital computer.

The drawworks control system 110 provides a velocity command and a torque command signal to the drive controller 125. The drive 120 runs the motors 55 at the commanded velocity operating within the commanded torque value. The drive 120 uses regeneration when necessary to maintain the velocity considering power system limit requirements. Each drive 120 provides the motor velocity (with a signed integer to indicate the direction of movement) and the torque level (with a signed integer to indicate the direction of movement) feedback to the drawworks control system 110. The drive controller 125 also provides flags to the drawworks control system 110 to indicate various alarm conditions of the drive 120 and the motor 55.

The operator control center 115 or man-machine interface is, preferably, a console including throttle control joysticks, switches, and an industrial processor driven monitor 160 wherein the operator or driller can set and control certain operational parameters. For example, the operator controls the direction and velocity of the traveling block 20 movement using a movement control joystick 165 installed at the operator console. The travel of the movement control joystick 165 produces a linear analog electrical input signal provided to the drawworks PLC 155 of the drawworks control system 110. Preferably, the movement control joystick 165 is spring driven to force the movement control joystick 165 toward a center position, or zero throttle mode. From the zero throttle mode, the movement control joystick 165 is pushed into or out of a sideways PARK position and mechanically held, whereby accidental movement of the movement control joystick 165 is prevented. In the PARK position, an electrical signal is provided to the drawworks PLC 155 of the drawworks control system 110 for the PARK mode wherein the parking brake 75 of the braking arrangement 70 is enabled. Although the linear analog electrical input signal provided to the drawworks PLC 155 of the drawworks control system 110 is illustrated as provided through the use of throttle joysticks, it will be understood that various types of control devices may be provided, as well as means for activating such control devices, all within the scope of the present invention.

Optionally, an auxiliary means is used to control the friction brake 80 directly as a backup to the drawworks control system 110, alternatively, bypassing the drawworks control system 110 all together. For example, a brake control joystick 170 provides an auxiliary means to directly control the application of the disk brake 80 when necessary. Preferably, the brake control joystick 170 is spring driven to force the brake control joystick 170 towards the maximum braking position and a mechanical holding position is provided to prevent accidental movement of the brake control joystick 170 as a safety feature. The travel of the brake control joystick 170 also produces a linear analog electrical input signal provided to the drawworks PLC 155 of the drawworks control system 110.

Through the use of various switches and/or levers at the operator control center 115, the operator selects operational parameters, such as, for example, a gear selection switch 175, an override switch 185 and an emergency shutoff switch 200. Alternatively, the monitor is, for example, a Windows™ NT based industrial computer including a touch-screen monitor mounted in front of the operator as a part of the man-machine interface. The operator monitors and sets system parameters and operational parameters including; the number of active drives, the active gear selected, the traveling block position, the block speed, the hook load, the upper and lower position set points, the maximum traveling block velocity set point, the percentage of control disk brake applied, the parked condition, and any abnormal or alarm condition flags or messages. The operator can modify the upper and lower traveling block position set points, the maximum traveling block velocity set points and acknowledge certain alarms.

Based on the load and required drilling operation to be performed, the operator selects the appropriate gear and assigns motors using a user interface, such as the operator control center 115. Motor assignments and gears are modified with the movement control joystick 165 in the PARK position. The operator uses the movement control joystick 165 to provide an output signal to the drawworks control system 110 for selection of the direction and velocity of the rotation of the drum 65 and hence the traveling block 20 movement. The drive 120 maintains the velocity of the block 20 according to the position of the movement control joystick 165. The drawworks control system 110 continues in parking mode and will not attempt to hoist or lower the traveling block 20 if the drive 120 is not sufficient to handle the load. An advisory warning is displayed in the event of insufficient power.

For hoisting the traveling block 20, the operator, for example, sets the movement control joystick 165 in the hoisting position and the traveling block 20 and any associated equipment or suspended load accelerates upward until the traveling block reaches and maintains the velocity set by the position of the joystick set by the operator. As the traveling block 20 approaches the dynamically adjusted position limits (within the preselected maximum and minimum limits), the traveling block 20 automatically decelerates gradually and continuously until it reaches a small, pre-set minimum velocity at the predetermined position limits. For lowering the traveling block 20, the operator, for example, sets the movement control joystick 165 in the lowering position and the traveling block 20 and any associated equipment or suspended load accelerates downward (driven by the electrical motor 55, if required) to reach and maintain the velocity set by the position of the movement control joystick 165.

In typical operation, raising the traveling block 20 and the load attached thereto, the motors 55 associated with the drawworks 50 are activated to wind fast line 45 onto rotatable drum 65. Conversely, when the traveling block 20 is lowered, electrical motors 55 are disengaged and rotatable drum 65 is rotated so as to pay out the fast line 45 under the slowing effect of auxiliary brake 75. In the event that a faster downward travel speed is desired, the braking action of the brake arrangement 70 is reduced or de-energized completely. On the other hand, if the downward travel of the block 20 is to be slowed, the braking action of brake 75 is increasingly energized. In typical operation, the primary friction brake 80 may be operated by a primary brake operating lever.

However, in the system of the present invention, regenerative or dynamic braking of the one or more electric motors 55, controlled by the drive 120, is preferably used as the primary method of braking during all modes of movement and velocity control, and stopping of the traveling block 20. The drawworks control system 110 provides a velocity command signal to the drive 120 for hoisting, lowering and stopping, and the drive 120 maintains the velocity according to the velocity command signal provided using regeneration or dynamic braking when necessary. The friction brake 80 is used to back up or compliment this retarding force of regeneration and to hold the traveling block 20 and load in the parking mode.

To stop the traveling block 20 at a selected position in the derrick 10, for instance, for a short period of time, the movement control joystick 165 is placed in the center position (the zero throttle mode) and the movement of the traveling block 20 is suspended at the selected position in the derrick 10. If, after a predetermined time period, no hoist or lower command signal is issued, the drawworks control system 110 automatically enters the PARK mode and both the disc brake 80 and the parking brake 75 in the brake arrangement 70 are activated. If the operator selects the parking position (PARK position) on the movement control joystick 165 the drawworks control system 110 enters the PARK mode and the traveling block 20 is held stationary. In the PARK mode, the drawworks control system 110 fully energizes the disk brake 80 and parking brake 75 of the brake arrangement 70 and provides a zero throttle signal to the drive 120. The drive 120 remains in a ready state until commanded off.

In an emergency situation, the operator can activate the emergency switch 200 to provide a command signal to the drawworks control system 110 to activate an emergency operation mode wherein the emergency brake 78 in the brake arrangement 70 is immediately energized. The drawworks control system 110 then also activates the disk brake 80 and parking brake 75 of the brake arrangement 70 with a speed recommended by the brake manufacturer, and provides a zero throttle signal to the drive 120. The emergency operations of the drawworks control system is, preferably, self-latching and, in order to exit the latching condition and resume normal operations, the movement control joystick 165 is placed in the PARK position.

Figure 3:
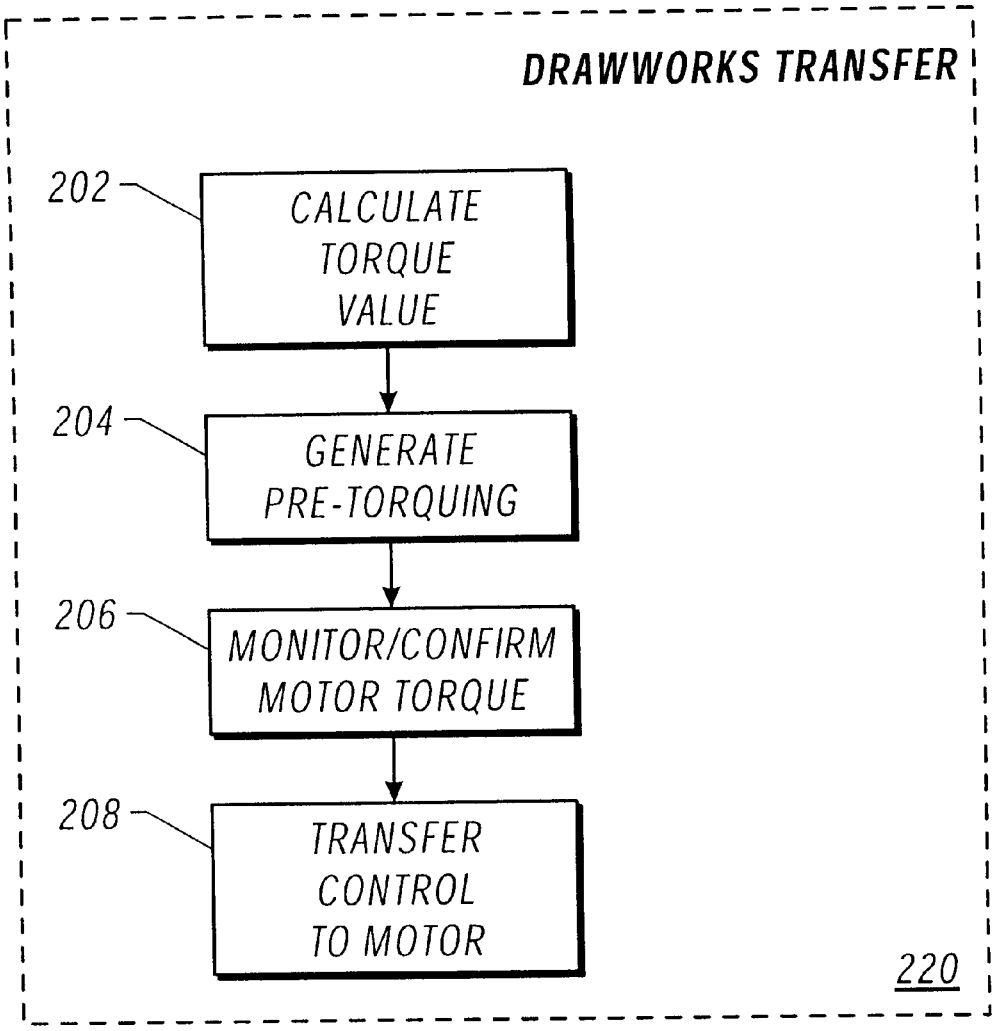
FIG. 3 is a flow diagram particularly illustrating the drawworks control system flow according to the present invention.
Figure 4:
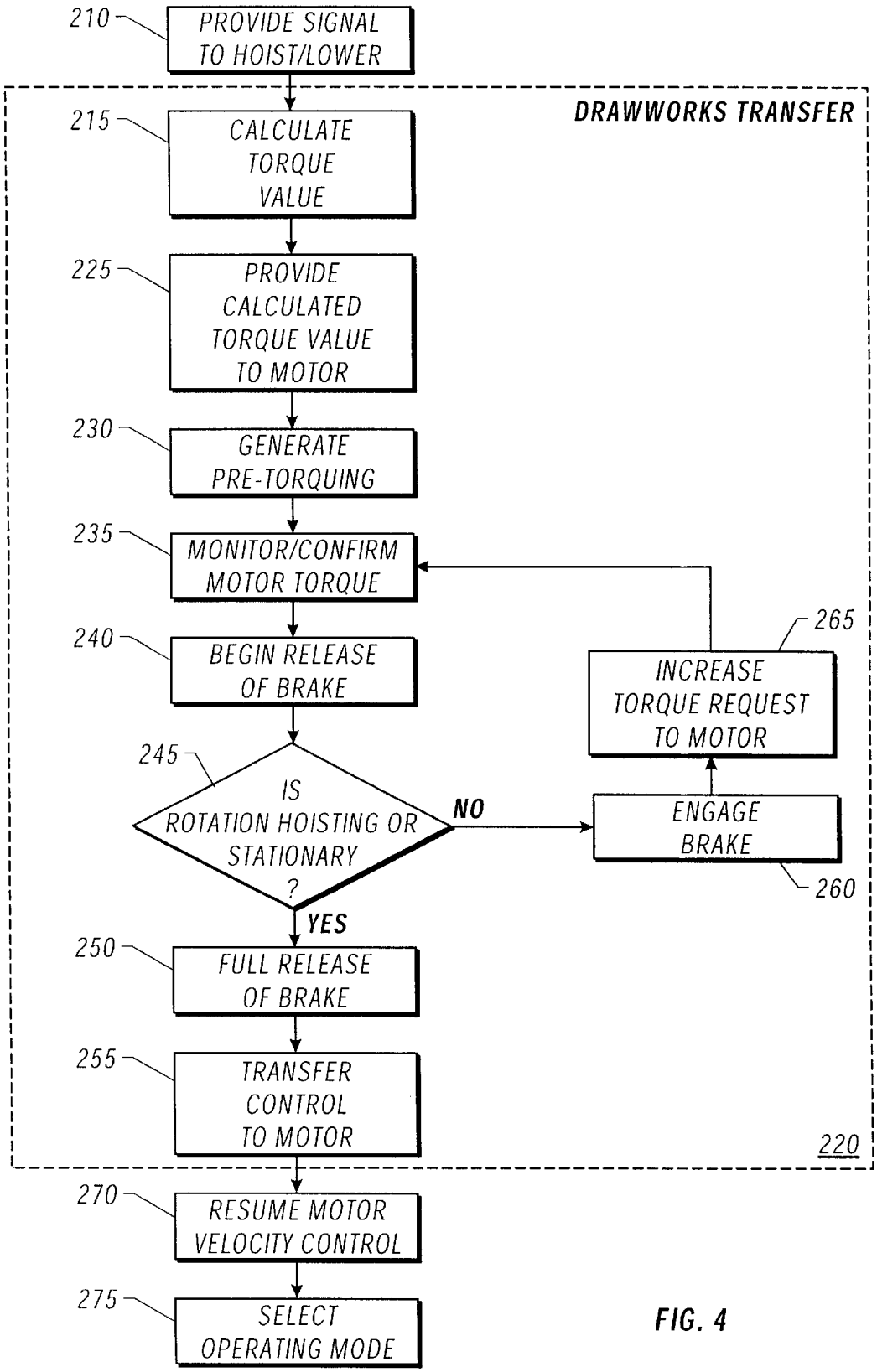
FIG. 4 is a flow diagram further illustrating the method of transferring control between the brake arrangement and a motor according to the present invention.

FIGS. 3 and 4 are flow charts illustrating the method of the present invention wherein the drawworks control system 110 provides for transfer of control of the drawworks 50 from the mechanical brake arrangement 70 to the at least one electrical motor 55, for example, when the traveling block 20 is switched from a parking mode to a running mode. Section 220 of FIG. 3 includes the method of the present invention wherein the drawworks control system 110 provides for the transfer from the brake arrangement 70 to the electrical motor 55. A calculated torque value is provided based on the hook load and the electrical motor 55 capacity, including the number of motors available for running to provide a calculated torque value per block 202. Pre-torquing is generated in the electrical motor 55, per block 204, based on the calculated torque value, and control of the rotation of the rotatable drum 65 is transferred from the brake arrangement 70 to the electrical motor 55 per block 208.

FIG. 4 illustrates the method of the present invention in greater detail wherein a velocity and direction of movement of the load is selected by the operator, or alternatively by a predetermined programmed operating mode, which provides a linear electrical signal to the drawworks control system 110 per block 210 wherein a control signal is provided from the drawworks control system 110 to hoist, lower, or stop the traveling block 20. For example, the drawworks control system 110 is removed from the PARK mode using the movement control joystick 165 as described and set in a running mode at a selected velocity. A torque value is calculated based on the hook load and the electrical motor 55 capacity, including the number of motors available for running to provide a calculated torque value per block 215. Per block 225 the drawworks control system 110 provides a signal representative of the calculated torque value to the electrical motor 55, and pre-torquing is generated in the electrical motor 55, per block 230.

For example, for a dc motor, the drawworks control system 110 provides the torque command signals in the form of an armature current limit and a velocity signal to the drive 120 connected to the electrical motor 55 wherein the drive 120 generates pre-torquing of the electrical motor 55. For an ac motor, the drawworks control system 110 provides a direct torque command signal and velocity signal to the drive 120 wherein the drive 120 generates pre-torquing of the electrical motor 55.

At block 235, the drawworks control system 110 monitors the torque of the electrical motor 55 and confirms when the motor torque feedback is substantially equal to the calculated torque value in order to transfer control from the brake arrangement 70 to the electrical motor 55. While monitoring the torque level of the electrical motor 55, the drawworks control system 110 provides a disabling signal to the brake arrangement 70 to commence a gradual release of the brake arrangement 70 from the rotatable drum 65 per block 240. A determination is made during the process of the gradual release of the brake arrangement 70 at block 245 as to whether the rotation of the rotatable drum 65 is moving in the hoisting direction or is stationary. If the rotation of the rotatable drum 65 is moving in the hoisting direction or is stationary, the drawworks control system 110 provides a disabling signal to the brake arrangement 70 and to fully release the brake arrangement 70 per block 250 when the monitored electrical motor 55 pre-torquing level is substantially equal to the calculated torque value. The drawworks control system 110 also provides a control signal to the electrical motor 55 to transfer control of the rotation of the rotatable drum 65 to the electrical motor 55 per block 255.

If, at bock 245, the rotatable drum 65 is not moving in the hoisting direction or is not stationary, but is instead moving in the lowering direction, then the drawworks control system 110 enables the brake arrangement 70 to apply the brakes to the rotatable drum 65 per block 260. The drawworks control system 110 increases the calculated torque value provided to the motor 55 per block 265, returns to block 235 and monitors the torque of the electrical motor 55 to confirm when the motor torque feedback is substantially equal to the increased calculated torque value. This cycle is repeated until the rotation of the rotatable drum 65 is moving in the hoisting direction or is stationary.

The brake arrangement 70 is then fully released and the drawworks control system 110 resumes velocity control according to the selected parameters per block 270. For example, the drawworks control system 110 provides a velocity signal command to the drive 120 and the traveling block 20 and associated equipment are maintained at the selected velocity and within the selected parameters using regenerative braking of the motor 55 when necessary.

An operating mode can be selected by the operator, per block 275. For example, in the running mode, an automatic drilling operation mode (AUTO DRILL mode) can be selected by the operator wherein controlling parameters for the AUTO DRILL mode of operation are predetermined. The drawworks control system 110 provides the velocity signal commands to the drive 120 and brake arrangement 70 for automatically moving the traveling block 20 within the operational range of a predetermined weight-on-bit (WOB). The rate-of-penetration (ROP) is monitored and the drawworks control system 110 also limits the velocity of the traveling block 20 such that the ROP remains within a predetermined range. The velocity and the position of the traveling block 20 are monitored by the position sensors 102 and the drawworks control system 110 also limits the movement of the traveling block 20 within pre-selected safety parameters including a crown saver height, a floor saver height, a WOB limit, and a ROP limit.

While preferred embodiments have been shown and described, various modifications and substitutions may be made thereto without departing from the spirit and scope of the invention. For example, it will be understood that different types of brakes may be provided in the brake arrangement, as well as means for activating such brakes, all within the scope of the present invention. Moreover, a particular drilling rig can include a variety of means for the operator input and interfacing such as the use of switches instead of the joysticks described, or through the use of a touch screen monitor. Accordingly it is to be understood that the present invention has been described by way of illustrations and not limitations.

What is claimed is:

1. A method for monitoring and controlling a drawworks including a rotatable drum on which a line is wound, wherein the drawworks and the line are used for facilitating movement of a load suspended on the line, the method comprising:

connecting a brake arrangement to the rotatable drum for limiting the rotation of the rotatable drum;

connecting at least one electrical motor to the rotatable drum for driving the rotatable drum;

producing a load signal representative of the load suspended on the line;

producing a calculated torque value based on the load signal and electrical motor capacity;

generating pre-torquing of the electrical motor based on the calculated torque value; and transferring control of the rotation of the rotatable drum from the brake arrangement to the electrical motor.

2. A method, as recited in claim 1, wherein, unless the rotation of the rotatable drum is in a lowering direction, the method further comprising:

commencing a gradual release of the brake arrangement from the rotatable drum; and wherein, when the electrical motor pre-torquing level is substantially equal to the calculated torque value, transferring control of the rotation of the rotatable drum to the electrical motor while fully releasing the brake arrangement from the rotatable drum.

3. A method, as recited in claim 1, wherein, when the rotation of the rotatable drum is in a lowering direction, the method further comprising:

engaging the brake arrangement to limit rotation of the rotatable drum; and increasing the calculated torque value;

wherein, when the rotation of the rotatable drum is no longer in a lowering direction and, when the electrical motor pre-torquing level is substantially equal to the increased calculated torque value, transferring control of the rotation of the rotatable drum to the electrical motor while fully releasing the brake arrangement from the rotatable drum.

4. A method, as recited in claim 1, further comprising:

providing a linear electrical output signal to a drawworks control system wherein said linear electrical output signal represents a selected velocity and direction of movement of the load; and providing control signals to the electrical motor from the drawworks control system to control the movement of the load according to the selected velocity and direction.

5. A method, as recited in claim 1, wherein the electrical motor is a direct current motor and wherein the step of generating pre-torquing of the electrical motor further comprises:

connecting a silicon controlled rectifier circuit to the electrical motor; and providing a signal representing the calculated torque value in the form of an armature current limit to the silicon controlled rectifier circuit for generating pre-torquing of the electrical motor.

6. A method, as recited in claim 1, wherein the electrical motor is an alternating current motor and wherein the step of generating pre-torquing of the electrical motor further comprises:

connecting an alternating current drive to the electrical motor; and providing a torque command signal representing the calculated torque value signal to the alternating current drive for generating pre-torquing of the electrical motor.

7. A method for monitoring and controlling a drawworks including a rotatable drum on which a line is wound, wherein the drawworks and the line are used for facilitating movement of a load suspended on the line, the method comprising:

connecting a brake arrangement to the rotatable drum for limiting the rotation of the rotatable drum;

connecting at least one electrical motor to the rotatable drum for driving the rotatable drum;

producing a load signal representative of the load suspended on the line;

producing a calculated torque value based on the load signal and electrical motor capacity; and generating pre-torquing of the electrical motor; and commencing a gradual release of the brake arrangement from the rotatable drum;

wherein, unless the rotation of the rotatable drum is in a lowering direction, transferring control of the rotation of the rotatable drum to the electrical motor while fully releasing the brake arrangement from the rotatable drum when the electrical motor pre-torquing level is substantially equal to the calculated torque value; and wherein, when the rotation of the rotatable drum is in a lowering direction, engaging the brake arrangement to limit rotation of the rotatable drum and increasing the calculated torque value;

wherein, when the rotation of the rotatable drum is no longer in a lowering direction, transferring control of the rotation of the rotatable drum to the electrical motor while fully releasing the brake arrangement from the rotatable drum when the electrical motor pre-torquing level is substantially equal to the increased calculated torque value.

8. A method, as recited in claim 7, further comprising:

providing a linear electrical output signal to a drawworks control system wherein said linear electrical output signal represents a selected velocity and direction of movement of the load; and providing control signals to the electrical motor from the drawworks control system to control the movement of the load according to the selected velocity and direction.

9. A method, as recited in claim 7, wherein the electrical motor is a direct current motor and wherein the step of generating pre-torquing of the electrical motor further comprises:

connecting a silicon controlled rectifier circuit to the electrical motor; and providing a signal representing the calculated torque value in the form of an armature current limit to the silicon controlled rectifier circuit for generating pre-torquing of the electrical motor.

10. A method, as recited in claim 7, wherein the electrical motor is an alternating current motor and wherein the step of generating pre-torquing of the electrical motor further comprises:

connecting an alternating current drive to the electrical motor; and providing a torque command signal representing the calculated torque value signal to the alternating current drive for generating pre-torquing of the electrical motor.

11. A system for monitoring and controlling a drawworks including a rotatable drum on which a line is wound, wherein the drawworks and the line are used for facilitating movement of a load suspended on the line, the system comprising:

a brake arrangement connected to the rotatable drum for limiting the rotation of the rotatable drum;

at least one electrical motor connected to the rotatable drum for driving the rotatable drum;

a load signal representative of the load on the line;

a calculated torque value based on the load signal and electrical motor capacity;

a drawworks control system for providing a signal representative of the calculated torque value to the electrical motor wherein pre-torquing is generated in the electrical motor in response to said signal; and wherein control of the rotatable drum is transferred from the brake arrangement to the electrical motor.

12. A system, as recited in claim 11, wherein, unless the rotation of the rotatable drum is in a lowering direction, the drawworks control system further providing a disabling signal for commencing a gradual release of the brake arrangement from the rotatable drum and wherein, when the electrical motor pre-torquing level is substantially equal to the calculated torque value, the drawworks control system transferring control of the rotation of the rotatable drum to the electrical motor while fully releasing the brake arrangement from the rotatable drum.

13. A system, as recited in claim 11, wherein, when the rotation of the rotatable drum is in a lowering direction, the drawworks control system further providing an enabling signal for engaging the brake arrangement to limit rotation of the rotatable drum and increasing the calculated torque value and wherein, when the rotation of the rotatable drum is no longer in a lowering direction and, when the electrical motor pre-torquing level is substantially equal to the increased calculated torque value, the drawworks control system transferring control of the rotation of the rotatable drum to the electrical motor while fully releasing the brake arrangement from the rotatable drum.

14. A system, as recited in claim 11, further comprising:

a movement control device for providing a linear electrical output signal to the drawworks control system wherein said linear electrical output signal represents a selected velocity and direction of movement of the load; and wherein the drawworks control system provides control signals to the electrical motor to control the movement of the load according to the selected velocity and direction.

15. A system, as recited in claim 14, wherein the movement control device is a throttle joystick.

16. A system, as recited in claim 11, wherein the electrical motor is a direct current motor, the system further comprising:

a silicon controlled rectifier circuit connected to the electrical motor; and a signal representing the calculated torque value provided by the drawworks control system in the form of an armature current limit to the silicon controlled rectifier circuit for generating pre-torquing of the electrical motor.

17. A system, as recited in claim 11, wherein the electrical motor is an alternating current motor, the system further comprising:

an alternating current drive connected to the electrical motor; and a torque command signal representing the calculated torque value signal provided by the drawworks control system to the alternating current drive for generating pre-torquing of the electrical motor.

18. A drilling rig comprising:

a derrick;

a traveling block, suspended from the derrick by a line connected to an anchor, for facilitating upward and downward movement of associated equipment into and out of a well bore;

a drawworks including a rotatable drum on which the line is wound;

at least one electrical motor connected to the rotatable drum for driving the rotatable drum;

a brake arrangement for limiting rotation of the rotatable drum;

a measuring device for producing a load signal representative of the load on the traveling block; and a drawworks control system for providing a calculated torque value based on the load signal and electrical motor capacity and for providing a signal representative of the calculated torque value to the electrical motor wherein pre-torquing is generated in the electrical motor in response to said signal;

wherein control of the rotatable drum is transferred from the brake arrangement to the electrical motor;

the drawworks control system provides a disabling signal to the brake arrangement and a control signal to the electrical motor to transfer control of the rotatable drum when the electrical motor pre-torquing level is substantially equal to the calculated torque value.

19. A drilling rig, as recited in claim 18, wherein, unless the rotation of the rotatable drum is in a lowering direction, the drawworks control system further providing a disabling signal for commencing a gradual release of the brake arrangement from the rotatable drum and wherein, when the electrical motor pre-torquing level is substantially equal to the calculated torque value, the drawworks control system transferring control of the rotation of the rotatable drum to the electrical motor while fully releasing the brake arrangement from the rotatable drum.

20. A drilling rig, as recited in claim 18, wherein, when the rotation of the rotatable drum is in a lowering direction, the drawworks control system further providing an enabling signal for engaging the brake arrangement to limit rotation of the rotatable drum and increasing the calculated torque value and wherein, when the rotation of the rotatable drum is no longer in a lowering direction and, when the electrical motor pre-torquing level is substantially equal to the increased calculated torque value, the drawworks control system transferring control of the rotation of the rotatable drum to the electrical motor while fully releasing the brake arrangement from the rotatable drum.

21. A drilling rig, as recited in claim 18, further comprising:

a movement control device for providing a linear electrical output signal to the drawworks control system wherein said linear electrical output signal represents a selected velocity and direction of movement of the load; and wherein the drawworks control system provides control signals to the electrical motor to control the movement of the load according to the selected velocity and direction.

22. A drilling rig, as recited in claim 21, wherein the movement control device is a throttle joystick.

23. A drilling rig, as recited in claim 18, wherein the electrical motor is a direct current motor, the system further comprising:

a silicon controlled rectifier circuit connected to the electrical motor; and a signal representing the calculated torque value provided by the drawworks control system in the form of an armature current limit to the silicon controlled rectifier circuit for generating pre-torquing of the electrical motor.

24. A drilling rig, as recited in claim 18, wherein the electrical motor is an alternating current motor, the system further comprising:

an alternating current drive connected to the electrical motor; and a torque command signal representing the calculated torque value signal provided by the drawworks control system to the alternating current drive for generating pre-torquing of the electrical motor.

25. A drilling rig, as recited in claim 18, further comprising:

an automatic control mode wherein the drawworks control system provides control signals to maintain the movement of the traveling block within predetermined operational parameters.

* * * * *